US005263872A

United States Patent [19]

Marpoe, Jr. et al.

[11] Patent Number: 5,263,872

[45] Date of Patent: Nov. 23, 1993

[54] ELECTRICAL SHORTING SYSTEM

[75] Inventors: Gary R. Marpoe, Jr., Kernersville; Christopher L. Allgood, Linwood; Donald W. K. Hughes, Kernersville, all of N.C.

[73] Assignee: The Whitaker Corporation, Wilmington, Del.

[21] Appl. No.: 994,863

[22] Filed: Dec. 22, 1992

[51] Int. Cl.[5] ..... H01R 29/00

[52] U.S. Cl. ..... 439/188; 200/51.1; 439/507

[58] Field of Search ..... 439/188, 507, 511, 512; 200/51.09, 51.10

[56] References Cited

U.S. PATENT DOCUMENTS

| | | | |
|---|---|---|---|
| 3,627,929 | 12/1971 | Gilissen et al. | 179/96 |
| 4,152,041 | 5/1979 | Hollyday et al. | 439/188 |
| 4,358,135 | 11/1982 | Tsuge et al. | 200/51.1 |
| 4,438,303 | 3/1984 | Astier | 200/51.1 |
| 4,552,423 | 11/1985 | Swengel, Jr. | 339/19 |
| 4,786,258 | 11/1988 | Shaffer | 439/188 |
| 4,798,542 | 1/1989 | Asick et al. | 439/188 |
| 4,832,614 | 5/1989 | Jenkins | 439/188 |
| 4,850,888 | 7/1989 | Denlinger et al. | 439/188 |
| 4,952,170 | 8/1990 | Pritulsky | 439/509 |
| 5,030,123 | 7/1991 | Silver | 439/188 |

*Primary Examiner*—Paula A. Bradley

*Attorney, Agent, or Firm*—Bruce J. Wolstoncroft

[57] ABSTRACT

A member (13) with a shorting contact (14) thereon is disposed in a receptacle housing (11). The shorting contact (14) is in mating electrical contact with an interface (15). When a header (12) is inserted into the receptacle housing (11), an inclined portion (29) of a beam (28) formed on the header (12) deflects the shorting contact (14) and opens the electrical circuit between the shorting contact (14) and the interface (15). Male pin contacts (25) in the header (12) electrically engage female contacts (21) within the receptacle housing (11) before the shorting circuit is broken. When the header (12) is removed from the receptacle housing (11) the shorting circuit is closed before electrical contact is opened between the male pin contacts (25) and the female contacts (21). In this manner, spurious signals are prevented. Extension means (32) extending from the sides of the beam (28) are disposed between the shorting contacts (14) and the interfaces (15) assuring the opening of the shorting circuit when the header (12) is inserted in the receptacle housing (11).

8 Claims, 6 Drawing Sheets

FIG. 1
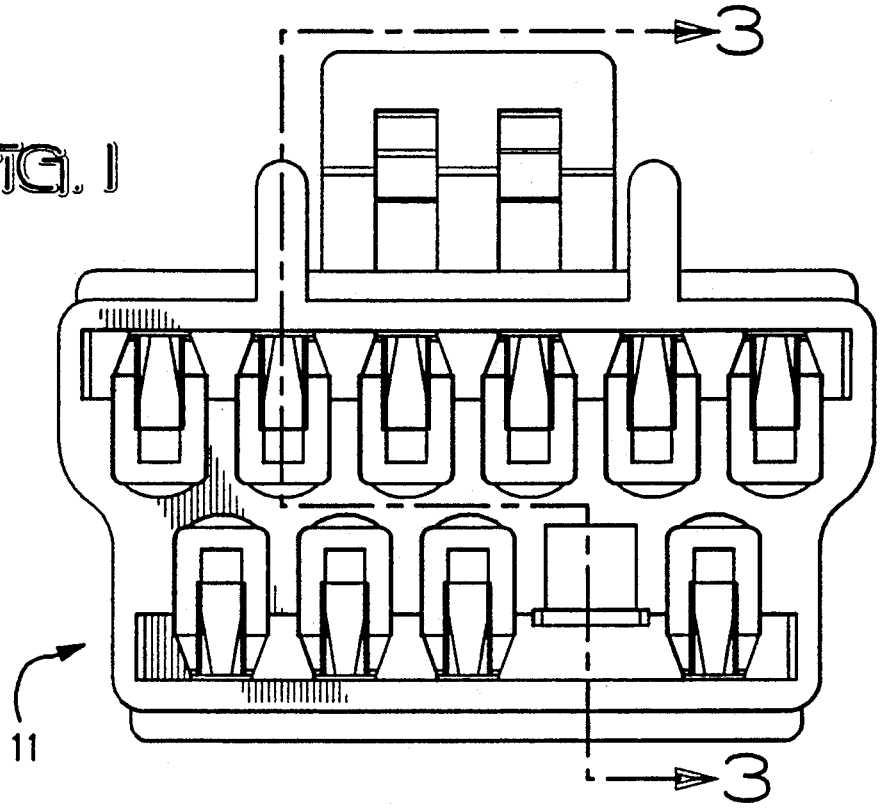
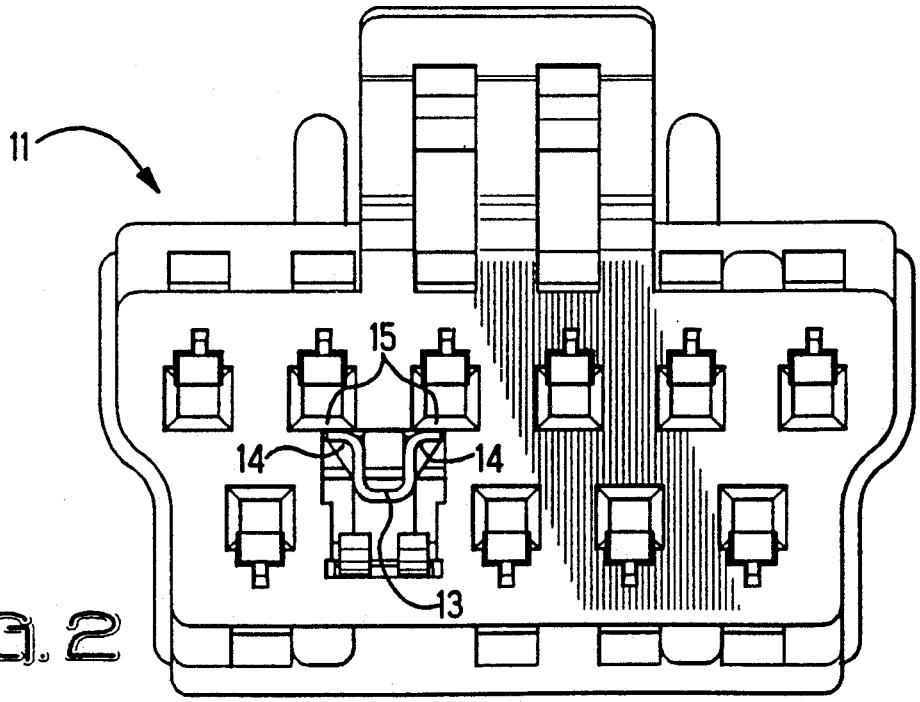
FIG. 2

ELECTRICAL SHORTING SYSTEM

The present invention relates to an electrical shorting system and more particularly, to shorting contacts in a housing receptacle into which a header is removably received.

BACKGROUND OF THE INVENTION

Electronic equipment is frequently assembled with a receptacle into which is removably inserted a header. Electrical connectors in the receptacle and on the header engage one another to make electrical contact. When the header is removed from the receptacle, the electrical circuit within the receptacle must be electrically shorted to provide a closed circuit. Shorting contacts formed within the receptacle are in a closed, conducting condition when the header is removed from the receptacle and the contacts are opened to a non-conducting condition when the header is inserted into the receptacle.

Preferably, the electrical conductors in the receptacle and on the header are engaged in electrical contact before the shorting circuit is opened during insertion of the header and the shorting circuit is closed before the electrical contact between said electrical conductors is broken when the header is removed. In this manner, spurious signals are not introduced into the circuit which could activate or deactivate the electronic equipment. One example of such equipment is in the electronics which controls deployment of an air bag in a motor vehicle. If spurious signals enter this electronic circuit, the air bag is inadvertently activated.

It is further desired that the electrical shorting system provide a very small centerline spacing to minimize the overall size of the equipment.

SUMMARY OF THE INVENTION

The present invention provides a shorting connection which is reliable in providing an open circuit when a header is inserted into a housing receptacle. The shorting connection also assures that spurious signals are not introduced into the circuit which may cause undesired effects.

In accordance with the teachings of the present invention, there is disclosed herein an electrical shorting system in a receptacle housing. A member has a shorting contact formed thereon, and the shorting contact is in mating electrical contact with an interface. The receptacle housing further has a female contact formed thereon. The receptacle housing removably receives therein a header having a male pin formed thereon. The female contact electrically cooperates with the male pin when the header is inserted into the receptacle housing. The header has a beam formed thereon to engage the shorting contact when the header is inserted into the receptacle housing such that the shorting contact is deflected from mating electrical contact with the interface. In this manner the electrical contact between the shorting contact and the interface is opened. The shorting contact has means thereon to receive the beam on the header. When the header is inserted into the housing receptacle, electrical contact is formed between the female contact and the male pin before the shorting contact is deflected from the interface. When the header is removed from the housing receptacle, electrical contact is formed between the shorting contact and the interface before electrical contact is broken between the female contact and the male pin. Thus spurious signals are prevented from being transmitted from external sources and from between the female contact and the male pin.

The member has a leg, and the top of the leg has the shorting contact formed thereon. The shorting contact makes electrical contact with the interface when the header is removed from the receptacle.

The beam on the header has an inclined portion formed thereon. The inclined portion contacts the leg having the shorting contact thereon when the header is inserted into the housing receptacle. In this manner, the top of the leg having the shorting contact is deflected from electrical contact with the interface.

These and other objects of the present invention will become apparent from a reading of the following specification, taken in conjunction with the enclosed drawings.

BRIEF DESCRIPTION OF THE DRAWINGS

FIG. 1 is a rear view of the receptacle housing prior to insertion of the header.

FIG. 2 is a front view of the receptacle housing prior to insertion of the header.

DETAILED DESCRIPTION OF THE PREFERRED EMBODIMENT

The present invention relates to an electrical shorting system which is included in a receptacle housing 11 wherein the shorting circuit is opened when a header 12 is inserted into the receptacle housing.

Figure 3:
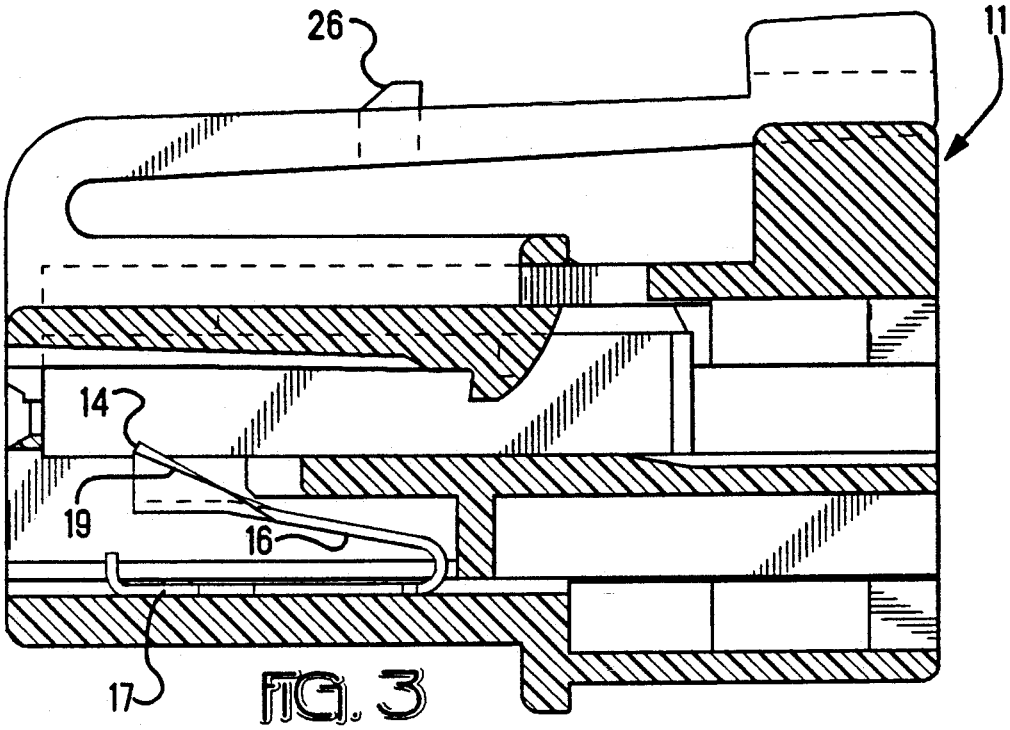
FIG. 3 is a cross-sectional view across the lines 3—3 of FIG. 1 with the shorting contact inserted.
Figure 4:
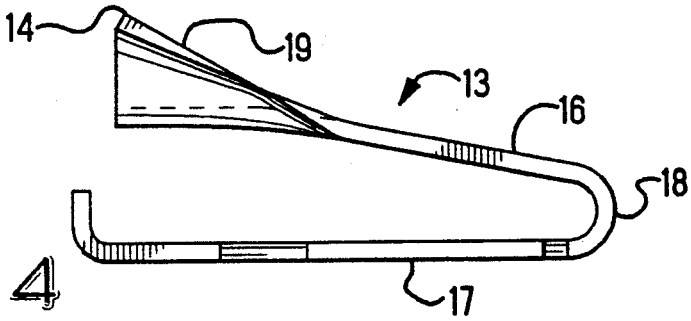
FIG. 4 is a side view of the member within the receptacle on which the shorting contact is formed showing the ramp portion of the first leg.
Figure 5:
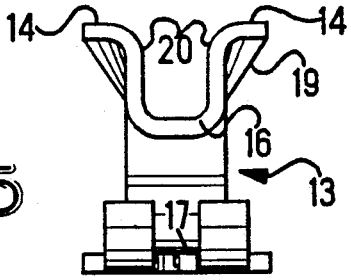
FIG. 5 is a front view of FIG. 4.
Figure 6:
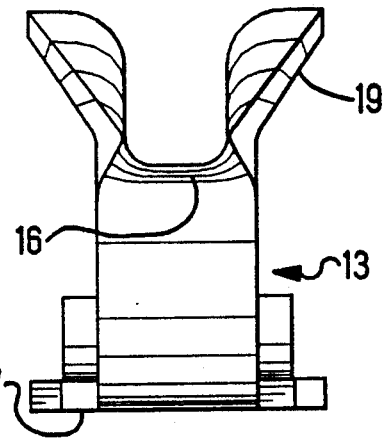
FIG. 6 is a rear view of FIG. 4.
Figure 7:
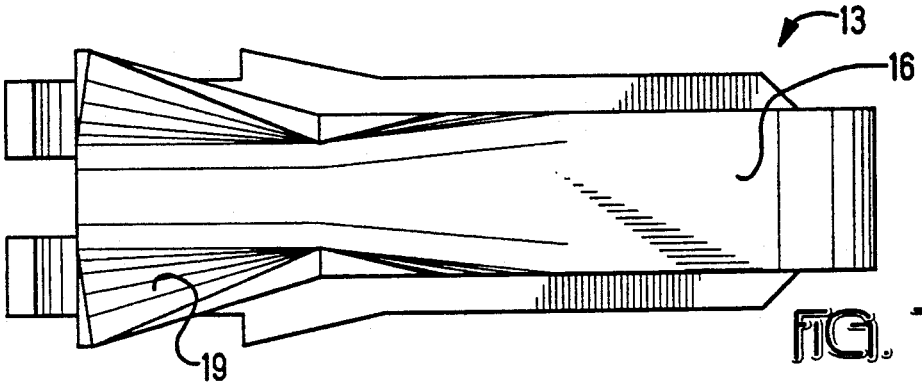
FIG. 7 is a top view of FIG. 4.
Figure 8:
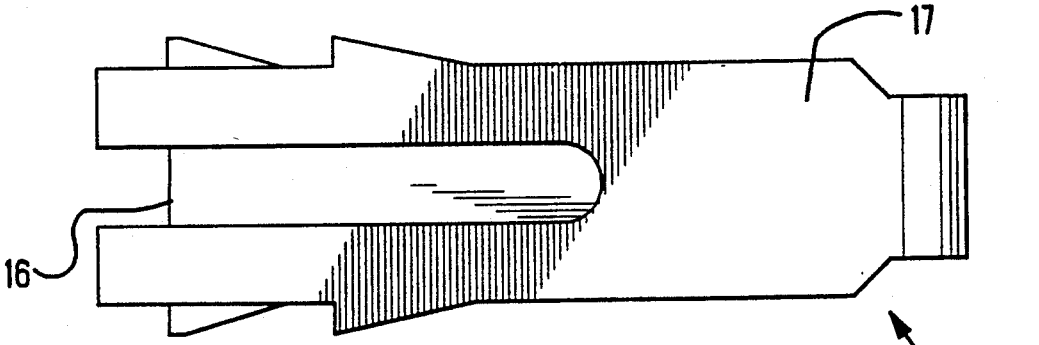
FIG. 8 is a bottom view of FIG. 4.

With reference to FIGS. 1–3, the receptacle housing 11 is formed with a plurality of cavities therein in which are disposed electrical contacts. The electrical contacts include at least one member 13 having a shorting contact 14 thereon and an interface 15 which is in mating electrical contact with the shorting contact 14 before insertion of the header 12. The member 13 is shaped in a "U" form with a first leg 16, a second leg 17, and a bight portion 18 between the legs (FIGS. 4–8). The bight portion 18 provides a resiliency between the legs 16, 17. A portion of the first leg 16 is formed as a ramp 19 which terminates at the end of the first leg 16, the end being the shorting contact 14. In a preferred embodiment, the end of the first leg 16 is formed in a "U" shape with two arms 20, 20. The upper ends of the arms 20 are the shorting contacts 14 wherein the member 13 may contact two interfaces 15 within the receptacle housing 11 to form a shorting circuit (see FIG. 2).

The ramp portion 19 in this preferred embodiment comprises parallel ramps which extend from the shorting contacts 14 toward the bight portion 18 of the member 13. This is shown in FIGS. 4–7. The receptacle housing 11 also includes a plurality of female contacts 21 which receive and electrically cooperate with male contacts in the header 12 as will be described. The interface 15 is a portion of female contact 21. The female contacts 21 are disposed in cavities within receptacle housing 11 which are offset from cavities in which are disposed the members 13 having the shorting contacts 14 (see FIGS. 1 and 3). The ramp portions 19 of the member 13 provide lead-in and prevent stubbing between the shorting contacts 14 and the female contacts 21.

Figure 9:
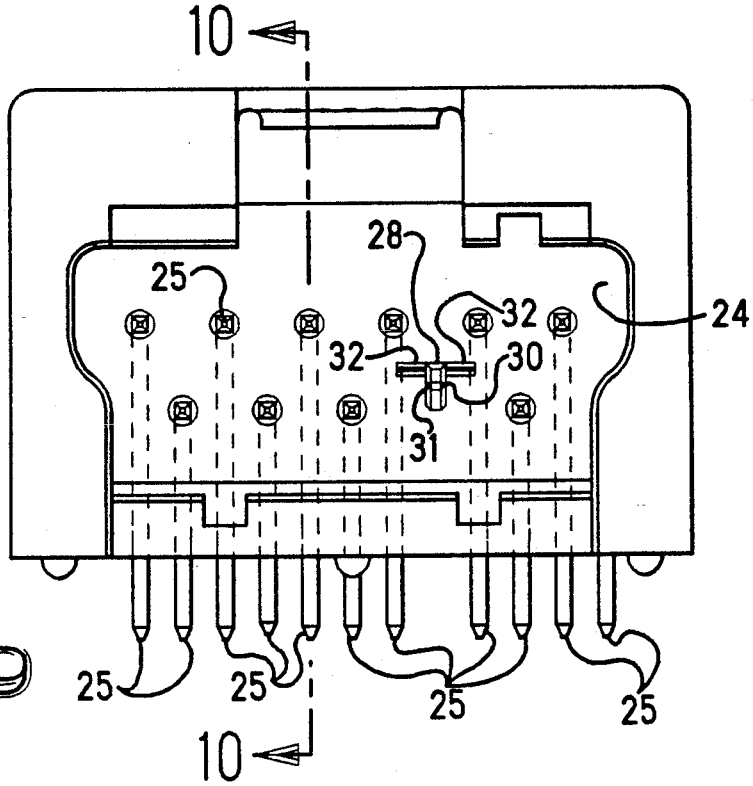
FIG. 9 is an front view of the header showing extension means on the beam.
Figure 10:
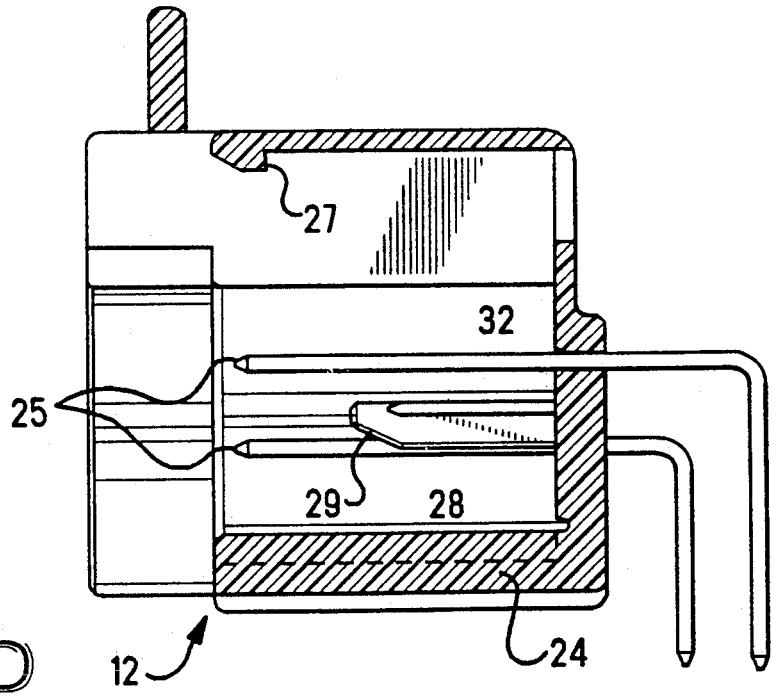
FIG. 10 is a cross-sectional view across the lines 10—10 of FIG. 9 with the pin inserted.

The header 12 has a "C" shaped body 24 which releasably receives the receptacle housing therein (FIGS. 9 and 10). A tab 26 on the receptacle housing 11 and a cooperating hook 27 on the header may be formed to provide a releasable connection therebetween. Extending through the center of the "C" shaped body 24 are a plurality of male pins 25 which terminate within the "C" shaped body 24. The male pins 25 are preferably spaced apart and aligned in two parallel horizontal rows although any desired arrangement may be employed. Also extending inwardly from the center of the "C" shaped body 24 are a plurality of beams 28. The beams 28 are interspaced and offset from the male pins 25. The end of the beam 28 distal from the center of "C" shaped body 24 has formed thereon an inclined portion 29. The beam 28 further has a first side 30 and a second side 31. An extension means 32 is formed on each respective side 30, 31 of the beam 28 and extend outwardly in a wing-like manner.

When the header 12 is inserted into the receptacle housing 11, the male pins 25 enter the respective cavities in the receptacle housing 11 in which the female contacts 21 are disposed and make electrical contact therebetween. The inclined portion 29 of the respective beam 28 contacts the first leg 16 of the respective member 13. In a preferred embodiment, said contact occurs between the two arms 20, 20 of the "U" shape on the end of the first leg 16 so that the beam 28 is guided to a desired position. As the header 12 is progressively inserted into the receptacle housing 11, the inclined portion 29 of the beam 28 causes the end of the first leg 16 of the member 13 to be deflected toward the second leg 17 of the member 13 overcoming the resiliency of the member 13. Electrical contact is broken between the shorting contacts 14 (the ends of the arms 20) and the interfaces 15 by this camming action. Electrical contact with the female contacts 21 is made before the beam 28 deflects the first leg 16 of the member 13 and, in this manner, electrical connection between the male pins 25 and the female contacts 21 is made before the shorting connection is broken between the shorting contacts 14 and the interfaces 15. Correspondingly, when the header 12 is removed from the receptacle housing, the reverse occurs. The resiliency of the member 13 urges the first leg 16 of the member 13 away from the second leg 17 as the inclined portion 29 of the beam 28 reduces the deflection of the first leg 16. When the header 12 has been withdrawn to a point where the inclined portion 29 of the beam 28 no longer deflects the first leg 16, electrical contact is made between the shorting contacts 14 and the interfaces 15. Further withdrawal of the header 12 breaks electrical contact between the male pins 25 and the female contacts 21. In this manner, the electrical contact between the male pins 25 and the female contacts 21 is assured before the shorting circuit is broken (opened) upon insertion of the header 12 into the receptacle housing 11 and upon removal of the header 12, connection of the shorting circuit is assured before electrical contact is broken (opened) between the male pins 25 and the female contacts 21. Thus, due to the system of the present invention, spurious signals are prevented from being transmitted between the electrical connections of the header 12 and the receptacle housing 11.

Figure 11:
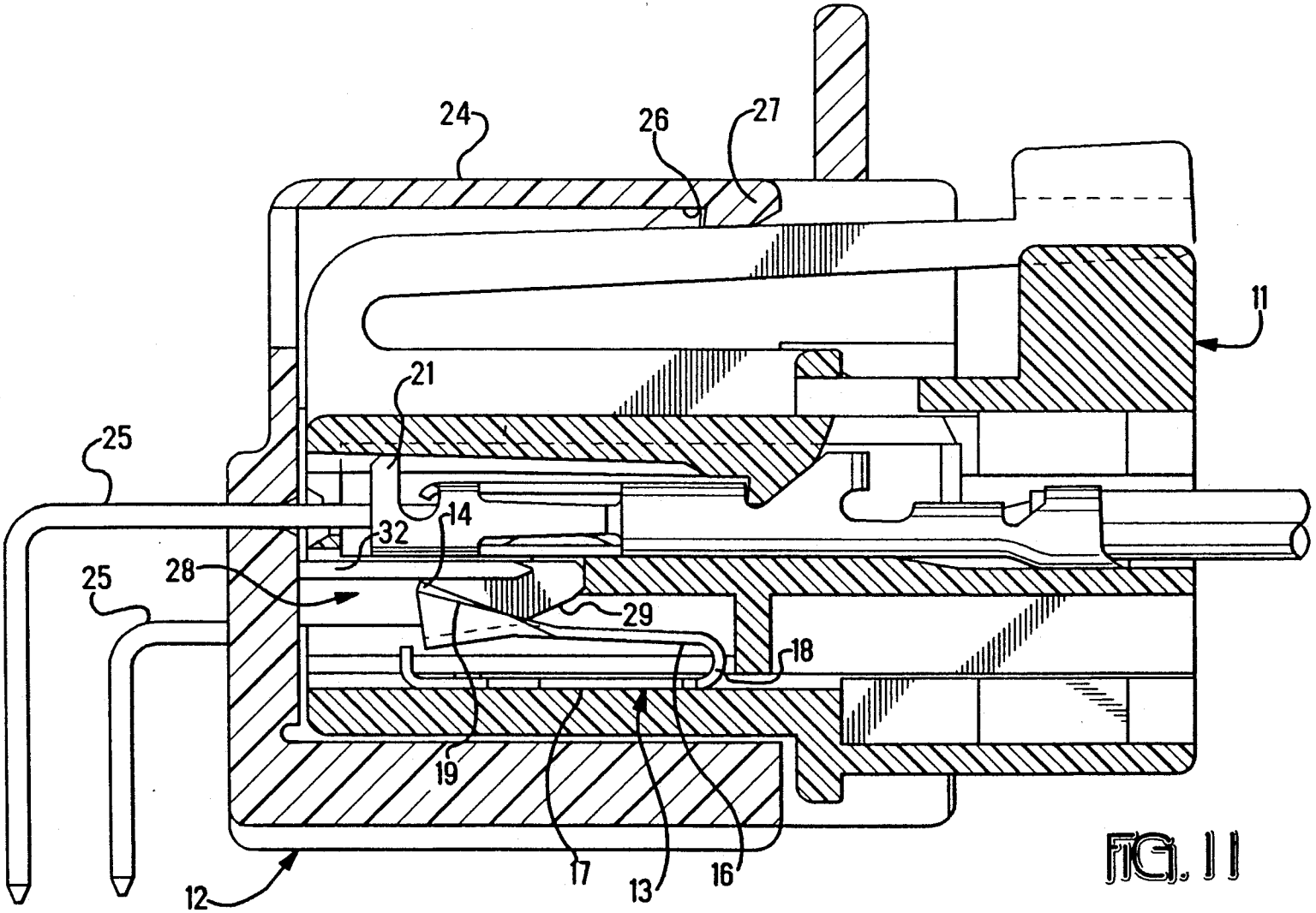
FIG. 11 is a cross-sectional view showing the header received in the receptacle housing and the beam on the header deflecting the shorting contact on the member in the receptacle housing.
Figure 12:
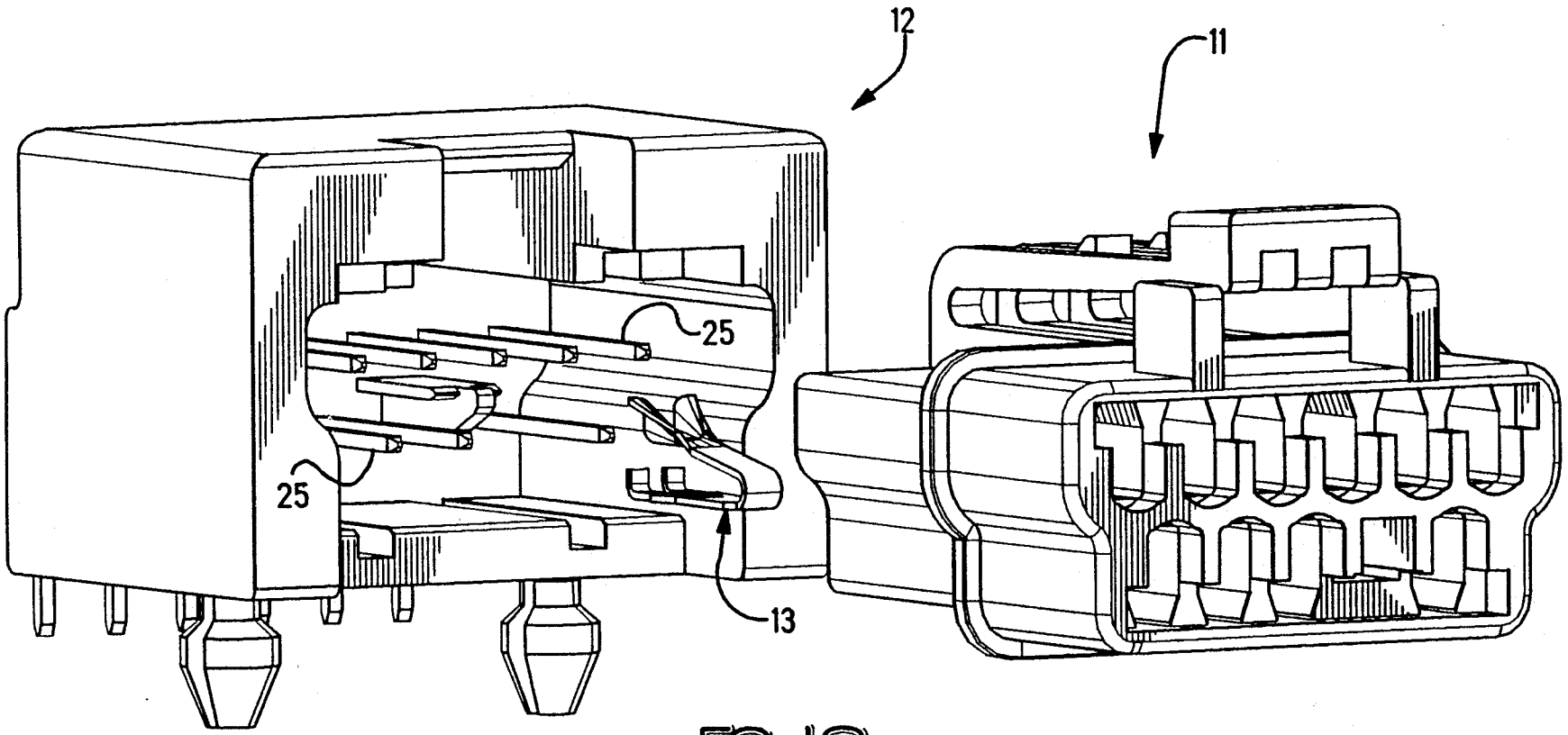
FIG. 12 is an exploded perspective view showing the header separated from the receptacle housing with the member having the shorting contact thereon disposed between the header and the receptacle housing.

A further feature is provided to assure that, after insertion of the header 12 into receptacle housing 11, the shorting contacts 14 do not engage or make electrical contact with the interfaces 15. As the shorting contacts 14 are displaced away from the interfaces 15, the extension means 32 on each respective side 30, 31 of the beams 28 are disposed in the area previously occupied by the shorting contacts 14. As can be seen in FIG. 11, the leading edge of the beam 28 extends beyond the leading edge of the extension means 32. Thus, the inclined portion 29 of the beam 28 deflects the shorting contacts 14 and provides an empty space into which the extension means 32 are introduced. When the extension means 32 are so disposed, the shorting contacts 14 are prevented from contacting the interfaces 15. The extension means 32 also provide an additional safety feature to the shorting system. In the event, that for any reason, the first leg 16 of the member 13 is not deflected when the header 12 is inserted into the receptacle housing 11, the extension means 32 on the beam 28 will stub against the arms 20, 20 of the first leg 16 and will prevent the mating of the header 12 and the receptacle housing 11. In this manner, the shorting system of the present invention assures that proper electrical contact is made between the header 12 and the receptacle housing 11.

The beam 28 and the extension means 32 are preferably formed from a material which does not conduct electricity, such as a plastic, to assure that no electrical connection can be made between the shorting contacts 14 and the interfaces 15 when the beam 28 and extension means 32 are disposed therebetween.

The system of the present invention also allows a very small centerline spacing between the shorting contacts 14 and the interfaces 15 so as to reduce the overall size of the assembly of header 12 and receptacle housing 11.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. In an electrical shorting system in a receptacle housing wherein a member having a shorting contact thereon is in mating electrical contact with an interface, the receptacle housing further having a female contact formed thereon, the receptacle housing removably receiving therein a header having a male pin formed thereon, said female contact electrically cooperating with said male pin when the header is inserted into the receptacle housing, the improvement comprising:

the header having a beam formed thereon to engage the member when the header is inserted into the receptacle housing such that the shorting contact on the member is deflected from mating electrical contact with the interface thereby opening electrical contact between the shorting contact and the interface, the member having means thereon to receive said beam on the header, such that when the header is inserted into the housing receptacle, the electrical contact is formed between the female contact and the male pin before the shorting contact is deflected from the interface and when the header is removed from the receptacle housing, electrical contact is formed between the shorting contact and the interface before electrical contact is broken between the female contact and the male pin, thereby preventing spurious signals from being transmitted.

2. The electrical shorting system of claim 1, further comprising the member having a leg, the leg having a top, the shorting contact being formed thereon, the shorting contact making electrical contact with the interface when the header is removed from the receptacle housing.

3. The electrical shorting contact of claim 2, wherein the beam on the header has an inclined portion formed thereon, the inclined portion contacting the leg having the shorting contact thereon when the header is inserted into the receptacle housing so that the top of leg having the shorting contact is deflected from electrical contact with the interface.

4. The electrical shorting contact of claim 1, wherein the beam has a first side and a second side, an extension means being formed on each respective side of the beam, said extension means being disposed between the shorting contact and the interface when the header is inserted into the housing receptacle.

5. The electrical shorting contact of claim 4, wherein the beam and extension means are formed of a material which does not conduct electricity.

6. An electrical shorting system in a receptacle housing, an insertable header, the header being slidably and removably received in the receptacle housing, the receptacle housing having a female connector formed thereon, the header having a male pin formed thereon wherein the female connector electrically cooperates with the male pin when the header is inserted into the receptacle housing, a member having a "U" shaped form with a first leg, a second leg and a bight portion therebetween, the bight portion providing a resiliency between the legs, the first leg having an end thereon, the end being an electrical contact to engage an interface in the receptacle housing for shorting the system, the header having a beam formed thereon, the beam having an inclined portion formed thereon, said inclined portion contacting the first leg of the member when the header is inserted in the receptacle housing and deflecting the first leg of the member toward the second leg of the member, wherein the end of the first leg is removed from electrical contact with the interface after the female connector electrically engages the male pin on the header, and wherein, when the header is removed from the receptacle housing, the end of the leg of the member is resiliently urged into electrical contact with the interface before the female connector electrically disengages the male pin on the header.

7. The electrical shorting system of claim 6, further comprising the beam having a first side and a second side, an extension means being formed on each respective side of the beam, wherein when the header is inserted into the receptacle housing, said extension means is disposed between the end of the first leg of the member and the interface, thereby assuring the absence of electrical contact between the end of the first leg of the member and the interface.

8. The electrical shorting system of claim 7, wherein the beam and the extension means are formed from a material which does not conduct electricity.

* * * * *